US005775700A

United States Patent [19]

Hornia et al.

[11] Patent Number: 5,775,700

[45] Date of Patent: Jul. 7, 1998

[54] PARTNERING GAME AND METHOD OF PLAYING SAME

[76] Inventors: Lester Hornia; Osmany Hornia, both of 175 W. 87th St., New York, N.Y. 10024

[21] Appl. No.: 855,676

[22] Filed: May 14, 1997

[51] Int. Cl.[6] ..... A63F 9/00

[52] U.S. Cl. ..... 273/459

[58] Field of Search ..... 273/236, 241, 273/138, 139, 459; 434/236, 237, 238

[56] References Cited

U.S. PATENT DOCUMENTS

| | | | |
|---|---|---|---|
| 3,764,135 | 10/1973 | Madison | 273/459 |
| 3,777,413 | 12/1973 | Zaccheo | 273/459 X |
| 3,967,825 | 7/1976 | Anania | 273/236 |
| 4,743,031 | 5/1988 | Lamle | 273/146 |
| 4,893,819 | 1/1990 | Wright | 273/243 |
| 5,080,364 | 1/1992 | Seidman | 273/139 X |
| 5,213,509 | 5/1993 | Gunn | 434/236 |

*Primary Examiner*—William E. Stoll

[57] ABSTRACT

A new Partnering Game and Method of Playing Same for enabling male and female players to determine whether or not a player of their liking likes them in such manner that only a mutually self-selected male-female couple knows of the selection. To play the game each of a plurality of male game players is given a single game token from a first set of game tokens having a distinct indicia thereon and each of a plurality of female game players is given a single game token having a distinct indicia thereon from a second set of game tokens. Each of the male game players and each of the female game players is also given a numbered card key. Each male game player and each female game player then deposit their game token into a numbered token box corresponding to the numbered key card held by a game player of the opposite sex of their desiring. Each male game player and each female game player then retrieves the game tokens from their numbered token boxes by means of their numbered card key. Each male game player and each female game player then place each game token retrieved from the numbered token boxes into the token pocket having a indicia corresponding to the indicia on each retrieved game token and the indicia of the game token originally given to each male game player and each female game player. Any token pocket having two game tokens therein indicates a potential partnership.

8 Claims, 2 Drawing Sheets

PARTNERING GAME AND METHOD OF PLAYING SAME

BACKGROUND OF THE INVENTION

1. Field of the Invention

The present invention relates to games and more particularly pertains to a new Partnering Game and Method of Playing Same for enabling male and female players to determine whether or not a player of their liking likes them in such manner that only a mutually self-selected male-female couple knows of the selection.

2. Description of the Prior Art

The use of games is known in the prior art. More specifically, games heretofore devised and utilized are known to consist basically of familiar expected and obvious structural configurations, notwithstanding the myriad of designs encompassed by the crowded prior art which have been developed for the fulfillment of countless objectives and requirements.

Known prior art games include U.S. Pat. No. 5,213,509; U.S. Pat. No. 4,893,819: U.S. Pat. No. 4,743,031; U.S. Pat. No. 5,080,364: and U.S. Pat. No. 3,967,825.

While these devices fulfill their respective, particular objectives and requirements, the aforementioned patents do not disclose a new Partnering Game and Method of Playing Same. The inventive device includes a first set of game tokens and a second set of game tokens of equal number, the first set of game tokens and the second set of game tokens being distinguishable from each other and having distinguishable indicia thereon, a plurality of token pockets having a pair of indicia thereon and adapted to receive two game tokens in side-by-side relation to one another, and a plurality of token boxes adapted to receive at most one set of game tokens.

In these respects, the Partnering Game and Method of Playing, Same according to the present invention substantially departs from the conventional concepts and designs of the prior art, and in so doing provides an apparatus primarily developed for the purpose of enabling male and female players to determine whether or not a player of their liking likes them in such manner that only a mutually self-selected male-female couple knows of the selection.

SUMMARY OF THE INVENTION

In view of the foregoing disadvantages inherent in the known types of games now present in the prior art, the present invention provides a new Partnering Game and Method of Playing Same construction wherein the same can be utilized for enabling male and female players to determine whether or not a player of their liking likes them in such manner that only a mutually self-selected male-female couple knows of the selection.

The general purpose of the present invention, which will be described subsequently in greater detail, is to provide a new Partnering Game and Method of Playing Same apparatus and method which has many of the advantages of the games mentioned heretofore and many novel features that result in a new Partnering Game and Method of Playing Same which is not anticipated, rendered obvious, suggested, or even implied by any of the prior art games, either alone or in any combination thereof.

To attain this, the present invention generally comprises a first set of game tokens and a second set of game tokens of equal number, the first set of game tokens and the second set of game tokens being distinguishable from each other and having distinguishable indicia thereon, a plurality of token pockets having a pair of indicia thereon and adapted to receive two game tokens in side-by-side relation to one another and a plurality of token boxes adapted to receive at most one set of game tokens.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new Partnering Game and Method of Playing Same apparatus and method which has many of the advantages of the games mentioned heretofore and many novel features that result in a new Partnering Game and Method of Playing Same which is not anticipated, rendered obvious suggested, or even implied by any of the prior art games, either alone or in any combination thereof.

It is another object of the present invention to provide a new Partnering Game and Method of Playing Same which may be easily and efficiently manufactured and marketed.

It is a further object of the present invention to provide a new Partnering Game and which is of a durable and reliable construction.

An even further object of the present invention is to provide a new Partnering Game and Method of Playing Same which is susceptible of a low cost of manufacture with regard to both materials and labor, and which accordingly is then susceptible of low prices of sale to the consuming public, thereby making such Partnering Game economically available to the buying public.

Still yet another object of the present invention is to provide a new Parterning Game and which provides in the apparatuses and methods of the prior art some of the advantages thereof, while simultaneously overcoming some of the disadvantages normally associated therewith.

Still another object of the present invention is to provide a new Partnering Game and for enabling male and female players to determine whether or not a player of their liking likes them in such manner that only a mutually self-selected male-female couple knows of the selection.

Yet another object of the present invention is to provide a new Partnering Game and Method of Playing Same which includes a first set of game tokens and a second set of game tokens of equal number, the first set of game tokens and the second set of game tokens being distinguishable from each other and having distinguishable indicia thereon, a plurality of token pockets having a pair of indicia thereon and adapted to receive two game tokens in side-by-side relation to one another, and a plurality of token boxes adapted to receive at most one set of game tokens.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
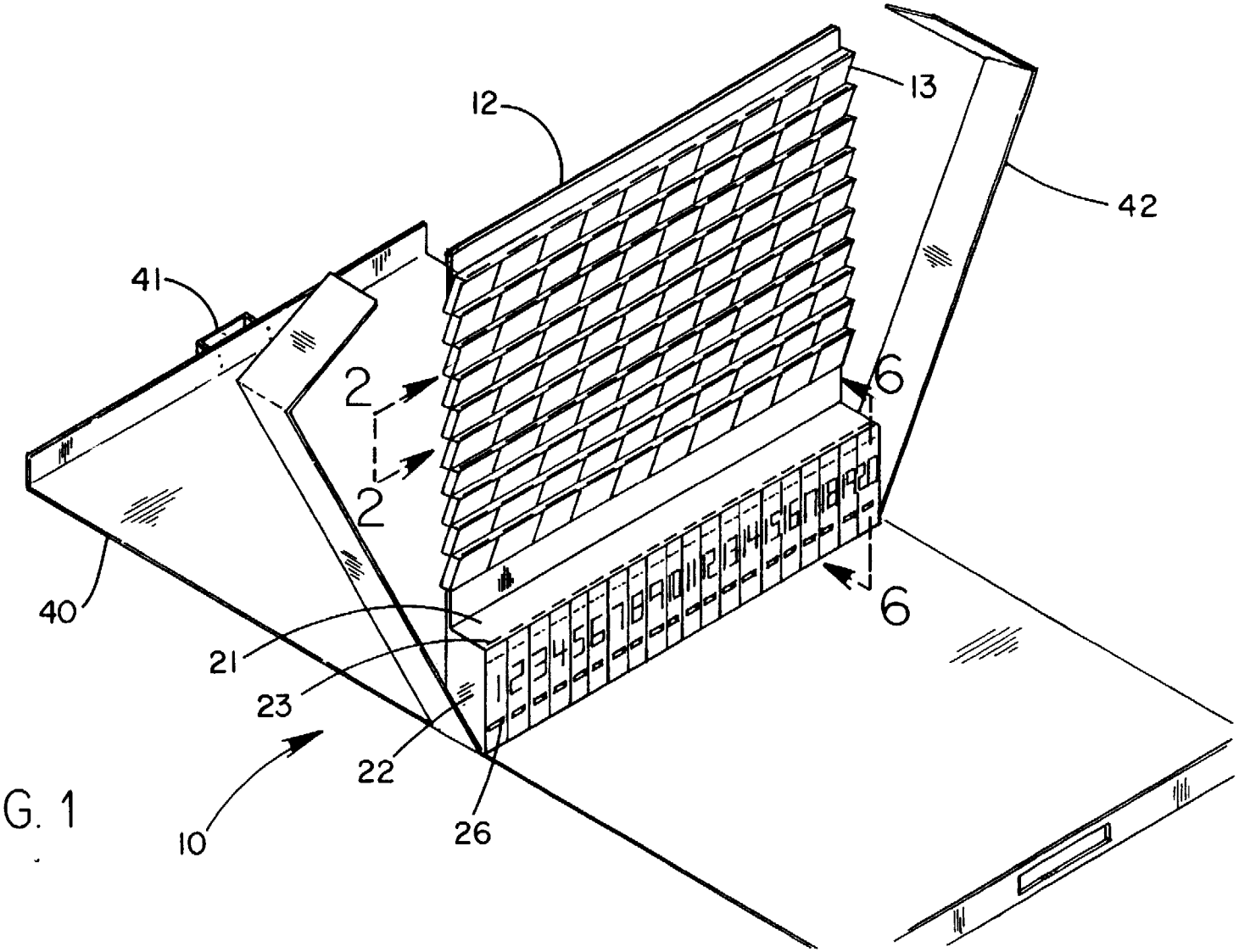
FIG. 1 is a perspective view of a new Partnering Game and according to the present invention.

With reference now to the drawings, and in particular to FIGS. 1 through 6A thereof a new Partnering Game embodying the principles and concepts of the present invention and generally designated by the reference numeral 10 will be described.

More specifically, it will be noted that the Partnering Game 10 comprises a plurality of game tokens 20 including a first set of game tokens and a second set of game tokens of equal number, the first set of game tokens and the second set of game tokens being distinguishable from each other and having distinguishable indicia thereon, a plurality of token pockets 13 having a pair of indicia 19 thereon and adapted to receive two game tokens 20 in side-by-side relation to one another, and a plurality of token boxes 22 adapted to receive at most one set of game tokens 20.

With reference to FIG. 1 there is shown the mounting member 12 having fixedly attached thereto an array of token pockets 13. The token pockets 13 are shown in an angled orientation relative to the mounting member 12. The columns of the array of token pockets 13 correspond to a first set of indicia 19 and the rows correspond to a second set of indicia 19. A plurality of token boxes 22 are shown fixedly attached to the mounting, member 13 and disposed below the token pockets 13. A carrying case 40 including side members 42 and handle 41 is shown containing the mounting member 12.

Figure 2:
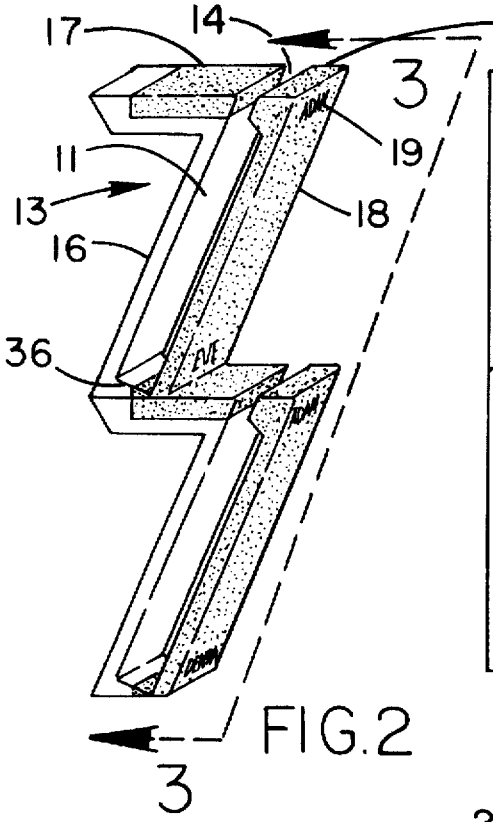
FIG. 2 is a cross sectional view taken along line 2—2 of FIG. 1.

With reference to FIG. 2 there is shown the token pocket 13 including front portion 15 formed of a non-transparent plastic material, a back portion 16 formed of a transparent material such as plastic, a bottom portion 36, side portions (not shown) and a top portion 17 having a token pocket slot 14 formed therein. The top portion 17, bottom portion 36, side portions and front portion 15 form an enclosure 11 therebetween. The enclosure 11 is formed to receive a pair of game tokens 20 in side-by-side relation to one another which are visible through the transparent back portion 16.

Figure 3:
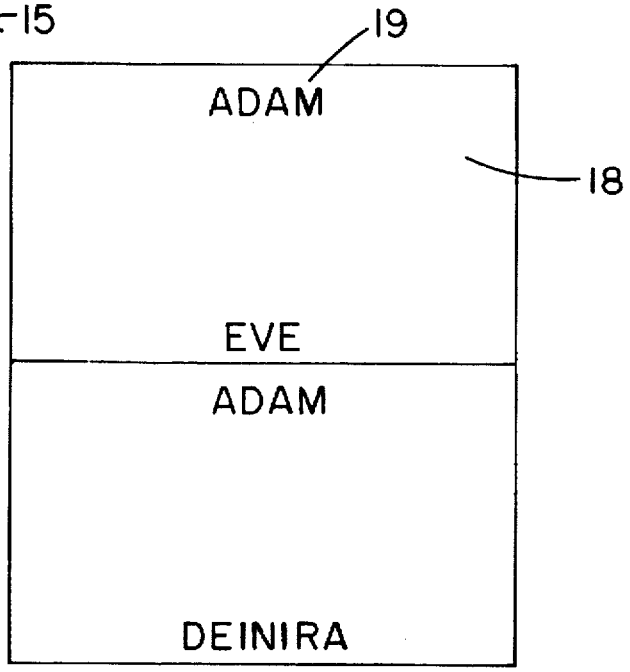
FIG. 3 is sectional view of the token pockets.

With reference to FIG. 3 there is shown the front surface 18 of the front portion 15 including two indicia 19, one indicia being from the first set of indicia and the other indicia being from the second set of indicia. The two indicia are such that no two front surfaces 18 have the same two indicia.

Figure 4:
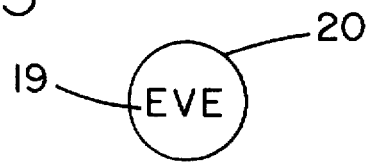
FIG. 4 is a plan view of a token of the present invention.

With reference to FIG. 4 there is shown a game token 20 including an indicia 19 disposed thereon. The game token 20 is preferably round.

Figure 5:
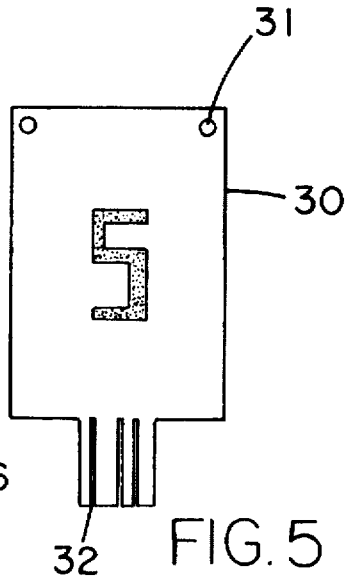
FIG. 5 is a plan view of a card key of the present invention.

With reference to FIG. 5 there is shown the numbered card key 30 including a plurality of apertures 32 formed at one end to codingly correspond to members (not shown) formed in a card key receiving, means such as card key aperture 26. A pair of holes 31 are shown formed in the numbered card key 30 to receive a means for hanging the numbered card key around each of the male and female game players neck's such as a piece of string.

Figure 6:
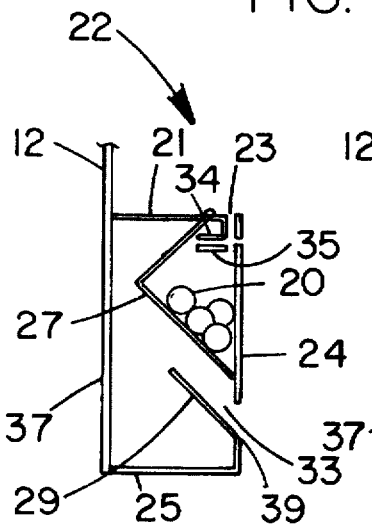
FIG. 6 is a cross sectional view taken along line 6—6 of FIG. 1 showing the token retaining member in it's closed position.
Figure 6A:
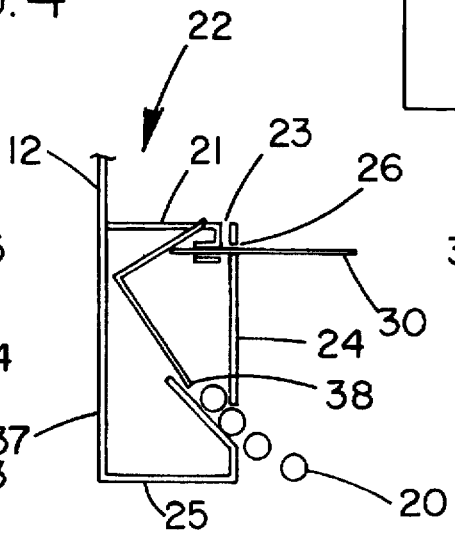
FIG. 6A is a cross sectional view of the token box showing the token retaining member in it's open position.

With reference to FIGS. 6 and 6A there is shown a numbered token box 22 manufactured of a resilient plastic material including a back section 37 which in the preferred embodiment includes the mounting member 12, a bottom section 25, two side sections (not shown), a front section 24 and a top section 21. The top section 21 includes a token box slot 23 for receiving game tokens 20. The game tokens 20 put into the numbered token box 22 are retained therein by means of a token retaining means such as token retaining member 27. The token retaining member 27 is integrally formed on the top section 21 and is biased in a closed position. Upon the insertion of the numbered card key 30, the numbered card key 30 is guided by first and second guide members 34 and 35 and engages the token retaining member 27 and moves it to an open position where a first end 38 engages a guiding means such as a third guide member 29 which is integrally formed on a front section lower portion 39. In this manner the game tokens 20 are guided through an aperture 33 shown formed in the front section 24.

To play the game each of a plurality of male game players is given a single game token 20 from the first set of game tokens and each of a plurality of female game players is given a single game token 20 from the second set of game tokens. Each of the male game players and each of the female game players is also given a numbered card key 30.

Each male game player and each female game player then deposits their game token 20 into the token box slot 23 of the numbered token box 22 corresponding to the numbered key card 30 held by a game player of the opposite sex of their desiring in a private manner. Each male game player and each female game player then retrieves the game tokens 20 from their numbered token boxes 22 in a private manner by inserting their numbered card key 30 into the corresponding card key receiving means 26 and retrieves the game tokens 20 deposited therein.

Each male game player and each female game player then privately place each game token 20 retrieved from the numbered token boxes 22 into the token pocket 13 having the indicia 19 corresponding to the indicia 19 on each retrieved game token 20 and the indicia 19 of the game token 20 originally given to each male game player and each female game player. The token pockets 13 are then viewed by the game players through the transparent back portion 16. Any token pocket 13 having two game tokens 20 therein indicates a potential partnership known only to the male and female game players having a mutual liking.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size materials, shape, form, function and manner of operation, assembly and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Method of Playing a Partnering Game comprising the steps of:

providing a plurality of game tokens, the game tokens further comprising a first set of game tokens and a second set of game tokens, the first set of game tokens being equal in number to the second set of game tokens and distinguishable therefrom, each of the game tokens of the first set of game tokens having distinguishable indicia from a first set of indicia thereon and each of game tokens of the second set of game tokens having distinguishable indicia from a second set of indicia thereon;

providing a plurality of token pockets, each of the token pockets having a pair of indicia thereon, a first indicia being from the first set of indicia and a second indicia being from the second set of indicia and wherein no two pair of indicia are the same, the token pockets further comprising a front portion, a back portion formed of a transparent material, a bottom portion, side portions and a top portion having a token pocket slot formed therein, the top portion, front portion, back portion, bottom portion and side portions forming an enclosure therebetween, the enclosure formed to receive a pair of game tokens in side-by-side relation to one another;

providing a plurality of numbered token boxes, each of the numbered token boxes having a back section, a bottom section, side sections, a numbered front section; and a top section having a token box slot formed therein and further comprising a token retaining means integrally formed thereon for retaining game tokens in a first position within the numbered token box when the token retaining means is in a closed position, the front section further comprising a card key receiving means for accepting a correspondingly numbered card key, the numbered card key being engageable to the token retaining means for moving the token retaining means to an open position wherein a first end of the token retaining means engages a guiding means integrally formed on a front section lower portion for guiding the game tokens held within the numbered token box through an aperture formed in the front section;

distributing to each of a plurality of male game players a single game token from the first set of game tokens and to each of a plurality of female game players a single game token from the second set of game tokens;

distributing to each of the male game players and to each of the female game players a numbered card key;

initiating play of the game by having each male game player and each female game player privately deposit their game token into the token box slot of the numbered token box corresponding to the numbered key card held by a game player of the opposite sex of their desiring;

continuing the game by having each male game player and each female game player privately retrieve the game tokens from their numbered token boxes by inserting their numbered card key into the corresponding card key receiving means and retrieving the game tokens therein; and continuing the game by having each male game player and each female game player privately place each game token retrieved from the numbered token boxes into the token pocket having the indicia corresponding to the indicia on each retrieved game token and the indicia of the game token originally given to each male game player and each female game player, and wherein two game tokens placed in a token pocket indicate a mutual liking.

2. The Method of Playing a Partnering Game of claim 1, wherein the token pockets are angled relative to a mounting member.

3. The Method of Playing a Partnering Game of claim 2, wherein the numbered token boxes are fixedly attached to the mounting member.

4. The Method of Playing a Partnering Game of claim 2, wherein the token pockets are fixedly attached to the mounting member in an array comprising a plurality of columns and rows, each column corresponding to an indicia from the first set of indicia and each row corresponding to an indicia from the second set of indicia.

5. The Method of Playing a Partnering Game of claim 2 further comprising the step of providing a carrying case for receiving the mounting member and token boxes.

6. The Method of Playing a Partnering Game of claim 1, wherein the first set of game tokens are blue and the second set of game tokens are red.

7. The Method of Playing a Partnering Game of claim 1, wherein each numbered card key further comprises a pair of holes formed therein, the holes being formed to receive a means for hanging the numbered card key around each of the male and female game players neck's.

8. The Method of Playing a Partnering Game of claim 1, wherein the game tokens are round.

* * * * *